US010446940B2

(12) United States Patent
Kawaguchi et al.

(10) Patent No.: US 10,446,940 B2
(45) Date of Patent: Oct. 15, 2019

(54) ANTENNA APPARATUS

(71) Applicant: DENSO CORPORATION, Kariya, Aichi-pref. (JP)

(72) Inventors: Kazushi Kawaguchi, Nishio (JP); Kazumasa Sakurai, Nishio (JP); Toshiya Sakai, Nishio (JP); Asahi Kondo, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/754,433

(22) PCT Filed: Aug. 8, 2016

(86) PCT No.: PCT/JP2016/073249

§ 371 (c)(1),
(2) Date: Feb. 22, 2018

(87) PCT Pub. No.: WO2017/033722

PCT Pub. Date: Mar. 2, 2017

(65) Prior Publication Data

US 2018/0331432 A1 Nov. 15, 2018

(30) Foreign Application Priority Data

Aug. 25, 2015 (JP) ..... 2015-165908

(51) Int. Cl.

| | |
|---|---|
| ***H01Q 21/08*** | (2006.01) |
| ***H01Q 13/10*** | (2006.01) |
| ***H01Q 13/18*** | (2006.01) |
| ***H01Q 19/00*** | (2006.01) |
| ***H01Q 21/29*** | (2006.01) |

(Continued)

(52) U.S. Cl.

CPC ..... *H01Q 21/08* (2013.01); *H01Q 9/045* (2013.01); *H01Q 13/10* (2013.01); *H01Q 13/18* (2013.01); *H01Q 19/005* (2013.01); *H01Q 21/29* (2013.01); *H01Q 21/0075* (2013.01)

(58) Field of Classification Search

CPC .... H01Q 13/10; H01Q 13/18; H01Q 21/0075; H01Q 21/08; H01Q 21/29; H01Q 9/045; H01Q 19/005

See application file for complete search history.

(56) References Cited

U.S. PATENT DOCUMENTS 5,977,924 A 11/1999 Takei et al.
6,107,964 A * 8/2000 Hirabe ..... H01Q 1/38 343/700 MS

FOREIGN PATENT DOCUMENTS

JP H09-246852 A 9/1997
JP H10-032425 A 2/1998

(Continued)

*Primary Examiner* — Hoang V Nguyen

(74) *Attorney, Agent, or Firm* — Knobbe, Martens, Olson & Bear, LLP

(57) ABSTRACT

An antenna apparatus is equipped with a plurality of antennas arrayed in line. Ones of the antennas which lie at ends of the array of the antennas are referred to as end-side antennas, while the other antennas are referred to as inner antennas. The end-side antennas have a structure different from that of the inner antennas so as to decrease a difference in directionality between the antennas used as feed elements, thereby improving the accuracy in determining an arrival direction in a simple way without increasing an amount of calculation.

7 Claims, 10 Drawing Sheets

(51) Int. Cl.
*H01Q 9/04* (2006.01)
*H01Q 21/00* (2006.01)

(56) References Cited

FOREIGN PATENT DOCUMENTS

| | | | |
|---|---|---|---|
| JP | 2002-163762 | A | 6/2002 |
| JP | 2007-121165 | A | 5/2007 |

* cited by examiner

ANTENNA APPARATUS

CROSS REFERENCE TO RELATED DOCUMENT

The present application is a national stage application of PCT Application No. PCT/JP2016/073249, filed on Aug. 8, 2016, which claims the benefit of priority of Japanese Patent Application No. 2015-165908, filed on Aug. 25, 2015, the disclosure of which is incorporated herein by reference.

TECHNICAL FIELD

The present invention generally relates to an antenna apparatus which uses an MUSIC (Multiple Signal Classification) algorithm to calculate an arrival direction of a radio wave.

BACKGROUND ART

An array antenna MUSIC algorithm is known as a technique of determining an arrival direction of a radio wave using a signal received by a plurality of antennas constituting an array antenna. The MUSIC algorithm uses a mode vector in calculating the arrival direction. The mode vector represents a phase difference or amplitude difference between the antennas as a function of the arrival direction. All the antennas are designed to have uniform and ideal characteristics.

However, the characteristics of the antennas usually become different from each other due to asymmetry of arrangement of the antennas. Particularly, the antennas located on ends of the array antenna have a strong degree of coupling of only the edges thereof with the adjacent antennas, which results in asymmetrical radiation characteristics. Use of the ideal mode vector, therefore, leads to an error in calculating the arrival direction of the radio wave.

In order to alleviate the above problem, Japanese Patent First Publication No. 2007-121165 teaches techniques of correcting a variation in characteristics among the antennas using $C\gamma$ components where C denotes a matric representing mutual coupling between the antennas constituting each channel, and $\Gamma$ denotes a phase difference or an amplitude difference between the channels.

SUMMARY OF THE INVENTION

Problem to be Solved by the Invention

The prior art techniques using the $C\Gamma$ components, however, perform a matrix calculation to derive the $C\Gamma$ components for the correction, thus facing drawbacks in that lots of calculations are needed, and lots of memories are used for the calculations. The making of a matrix of the $C\Gamma$ components for the correction requires measurements using known reference signals, which requires effort and time.

The invention was made in view of the above problems. It is an object to provide a technique of improving the accuracy in calculating an arrival direction in a simple way without having to increase a load on calculation.

Means for Solving the Problem

An antenna apparatus of this invention is equipped with a plurality of antennas which are arrayed in line. End-side antennas which are ones of the antennas and lie at ends of an array of the antennas have a structure different from that of inner antennas which are ones of the antennas other than the end-side antennas for reducing a difference in directionality between ones of the antennas which are used as feed elements.

The above structure reduces a difference in directionality between the antennas used as the feed elements, thereby improving the accuracy in calculating an arrival direction without increasing the amount of calculation.

The reference symbols noted in brackets recited in claims represent correspondence relations to specific means described in embodiments, as will be discussed later, and do not limit the technical field of the invention.

EMBODIMENTS FOR CARRYING OUT THE INVENTION

Embodiments to which the invention is applied will be described below using the drawings.

This disclosure will refer to an antenna apparatus employed in millimeter-wave radar which calculates an arrival direction of a radio wave suing an MUSIC algorithm. In the following discussion, the transmission line wavelength of a radio wave transmitted or received by the antenna apparatus is expressed by λg.

1. First Embodiment

[1. 1 Structure]

Figure 1:
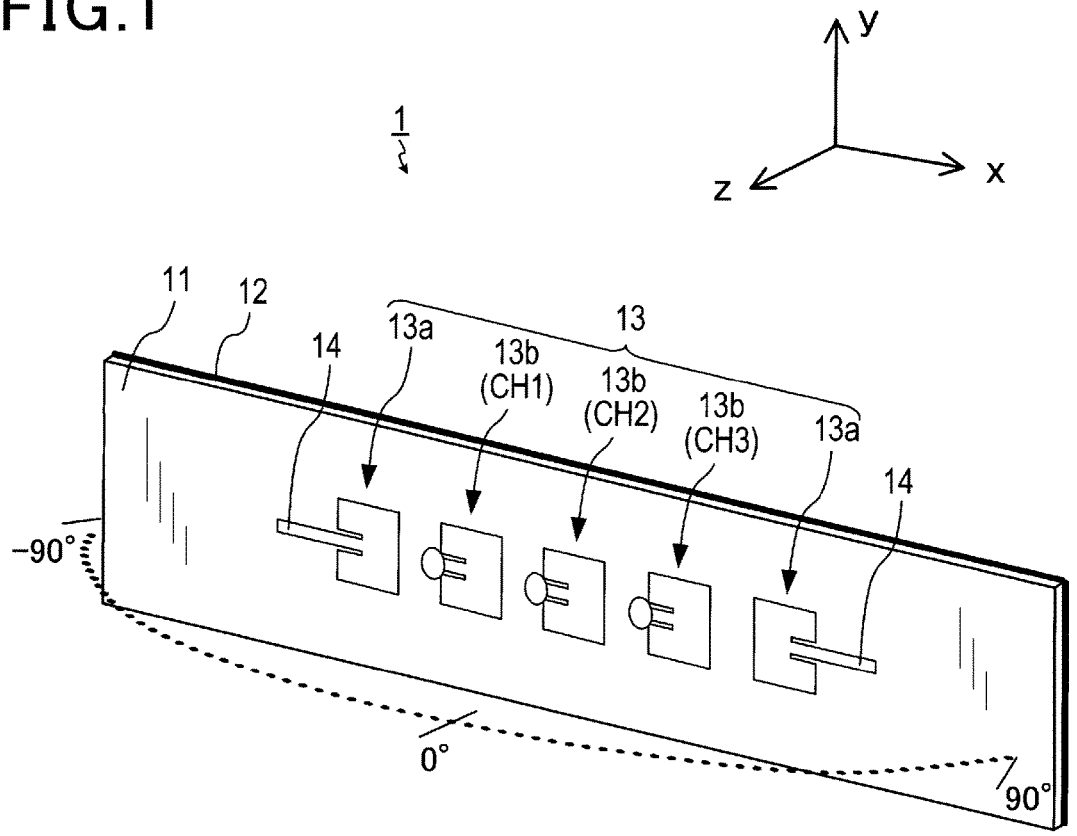
FIG. 1 is a perspective view which illustrates a structure of an antenna apparatus in the first embodiment.

The antenna apparatus 1, as illustrated in FIG. 1, includes the base plate 11, the ground pattern 12, the antenna pattern 13, and the feeders 14.

The base plate 11 is implemented by a known two-layer substrate made of dielectric material.

The ground pattern 12 is made of a copper pattern formed to cover the whole of one surface of the base plate 11.

The antenna pattern 13 is formed on a surface of the base plate 11 which is opposite a surface of the base plate 11 on which the ground pattern 12 is formed. The antenna pattern 13 is equipped with M antennas 13*a* and 13*b* where M is an integer of four or more.

Each of the antennas 13*a* and 13*b* is formed by a rectangular copper pattern which constitutes a microstrip antenna together with the base plate 11 and the ground pattern 12 and thus functions as a patch antenna.

The feeders 14 extend from the respective antennas 13*a* and 13*b* in a direction in which the antennas 13*a* and 13*b* are arrayed, that is, an X-axis direction in the drawing. The feeders 14 are each made of a copper stripped pattern which constitutes a microstripline together with the base plate 11 and the ground pattern 12.

The antennas 13*a* and 13*b* are shaped to have the same size and arranged in line at a given antenna interval d (see FIG. 2) away from each other. In the following discussion, outermost two of the antennas 13*a* and 13*b* which lie at ends of the array of the antennas 13*a* and 13*b* will be each referred to as an end-side antenna 13*a* or an outer antenna 13*a*, while the other antennas 13*b* will be each referred to as an inner antenna 13*b*.

The feeders of the inner antennas 13*b* have ends (not shown) connected to a transmitter-receiver circuit. The inner antennas 13*b* are, thus, each formed as a feed element (i.e., a driven element). The feeders 14 of the end-side antennas 13*a* have ends which are electrically opened. The end-side antennas 13*a* are, thus, each formed as a parasitic element. In other words, only M-2 inner antennas 13*b* are used to transmit or receive radio waves. In the following discussion, the inner antennas 13*b* will also be referred to as channels CH1, CH2, . . . as needed.

Figure 2:
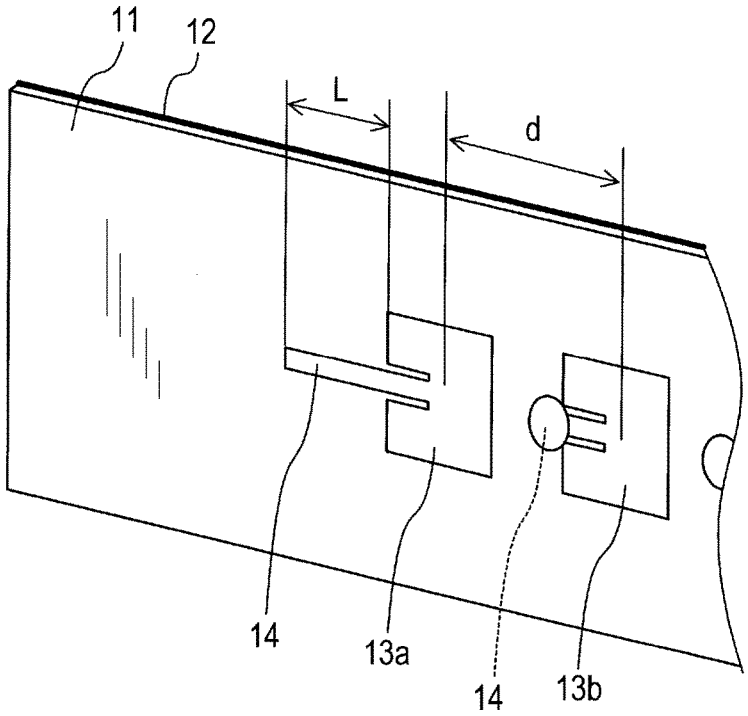
FIG. 2 is an enlarged view of a portion of an antenna apparatus.

The transmission line length L of the feeders 14 of the end-side antennas 13*a* illustrated in FIG. 2 is designed to meet a relation of $L=\lambda/2$. The transmission line length of the feeders of the inner antennas 13*b* is designed to be an integral multiple of λg/2.

[1.2. Measurement]

Figure 3:
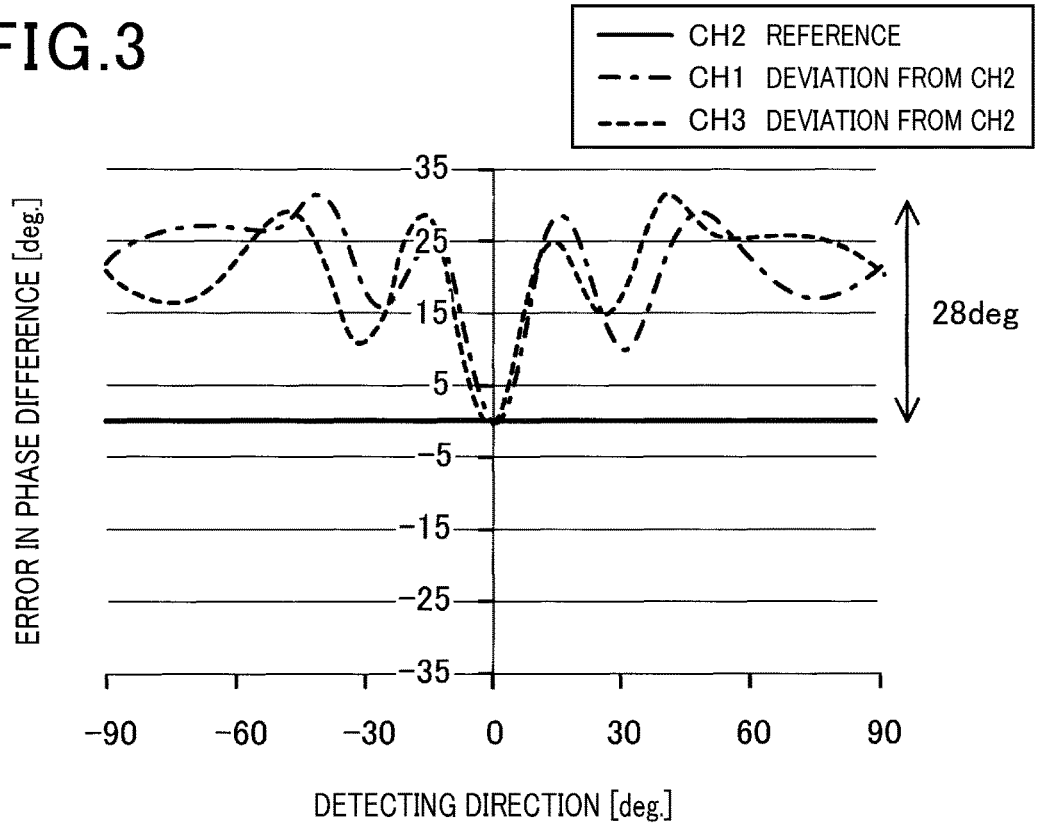
FIG. 3 is a graph which represents an error in phase difference detected by each antenna when there is no parasitic element.
Figure 4:
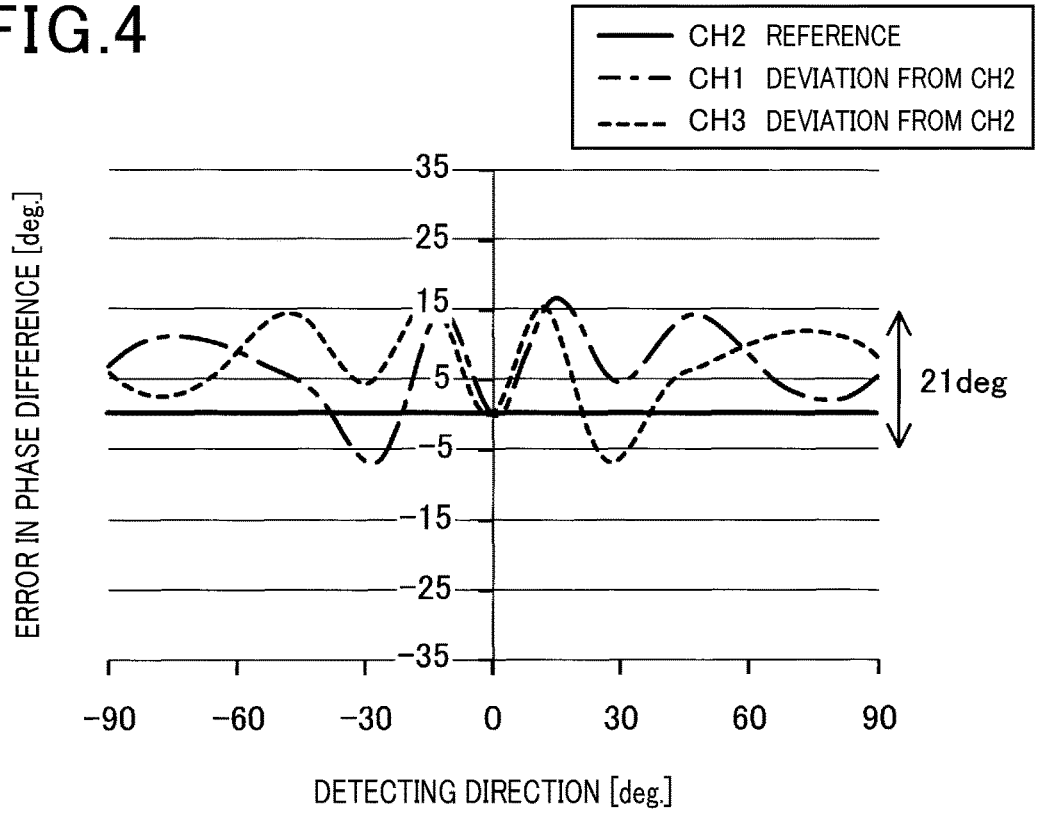
FIG. 4 is a graph which represents an error in phase difference detected by each antenna when there is a parasitic element.
Figure 5:
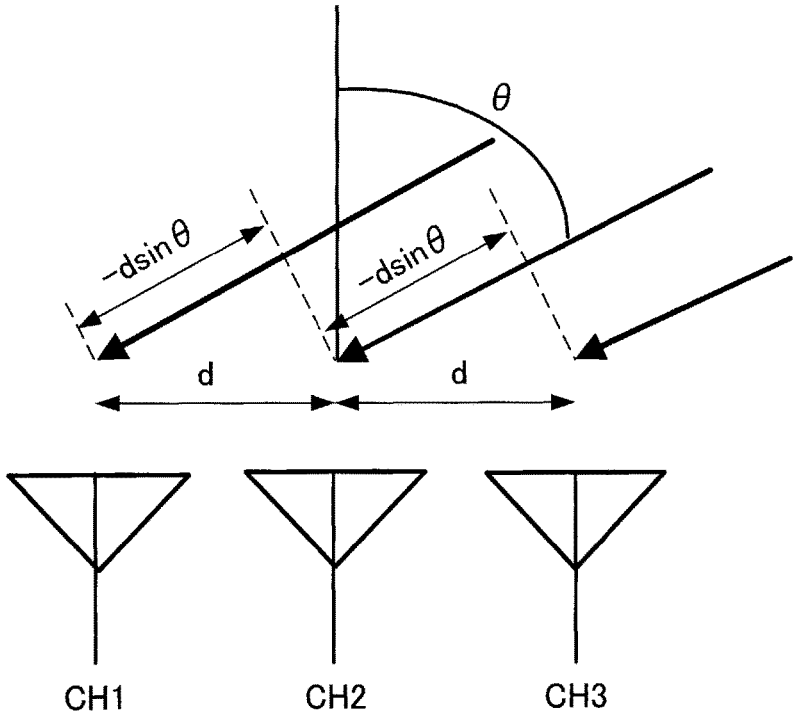
FIG. 5 is an explanatory view which represents a relation between a transmission path difference (i.e., a phase difference), as detected by each feed element and a detecting direction.
Figure 6:
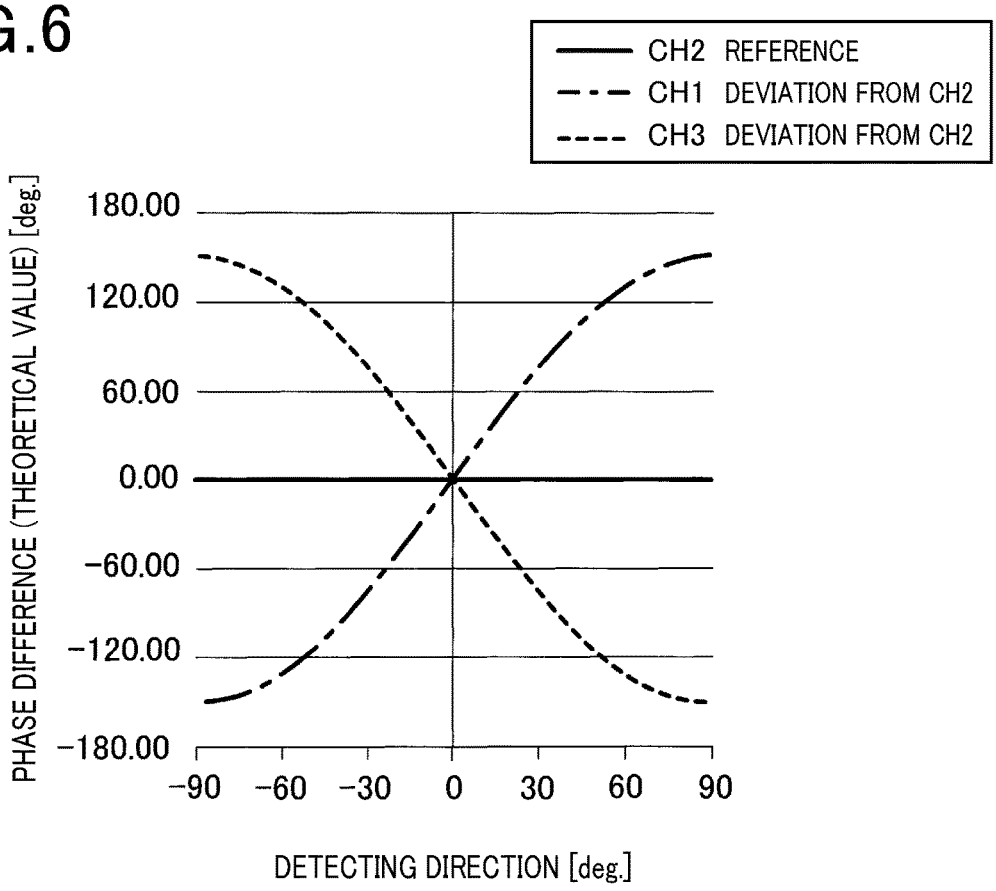
FIG. 6 is a graph which represents theoretical characteristics of a phase difference detected by each feed element.

FIGS. 3 and 4 represent results of simulations in the embodiment of the antenna apparatus 1 (M=5) in which the parasitic elements (i.e., the end-side antennas 13*a*) are disposed on both sides of the three feed elements (i.e., the inner antennas 13*b*) and a comparative example in which there are only three feed elements without use of parasitic elements. Specifically, FIGS. 3 and 4 indicate errors or deviations of phase differences, as detected by the respective feed elements, from a theoretical value on the basis of a middle one (i.e., the channel CH2) of the feed elements for each detecting direction (i.e., each arrival direction). Note that a relation between the antenna interval d and the detecting direction 9 is shown in FIG. 5. The theoretical value of the phase difference detected by each of the feed elements is represented in FIG. 6. In the simulations, the radio wave frequency is 24.15 GHz. The antenna interval d is 5.2 mm. The detecting direction θ is expressed by an angle where in the X-Z plane in FIG. 1, the Z-axis direction is defined as 0°, a counterclockwise direction from the Z-axis is expressed as plus, and a clockwise direction from the Z-axis is expressed as minus.

It has been found that a maximum error of the phase difference in the comparative example in FIG. 3 is 28 degrees, while it is improved to be 21 degrees in the embodiment of FIG. 4.

Figure 7:
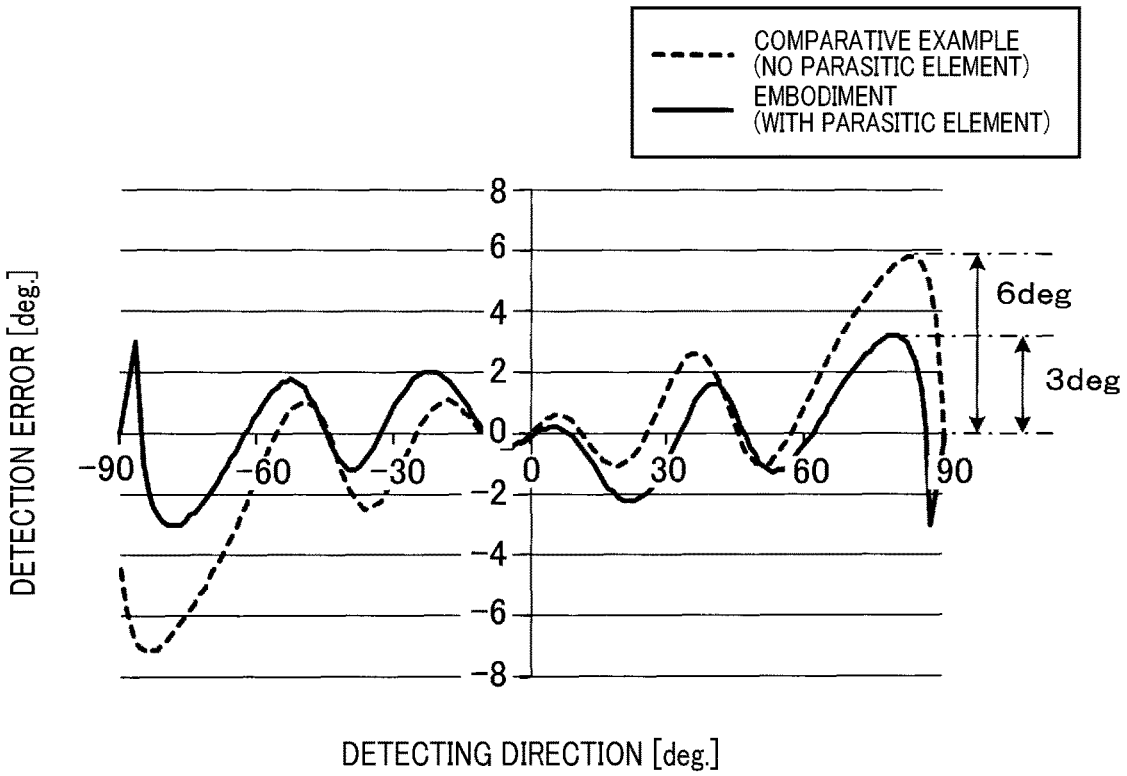
FIG. 7 is a graph which represents detecting errors of arrival directions derived using received signals in an antenna apparatus of the first embodiment and an antenna apparatus in a comparative example.

Detection errors of the arrival directions, as derived through MUSIC algorithm using received signals in the above embodiment and the comparative example are shown in FIG. 7. FIG. 7 shows that the detection error in the comparative example is 6 degrees, while the detection error in the embodiment is improved to be 3 degrees.

[1. 3. Effects]

As apparent from the above discussion, the antenna apparatus 1 is designed to have the parasitic elements (i.e., the end-side antennas 13*a*) which lie at the ends of the array of the feed elements (i.e., the inner antennas 13*b*) and work to reduce a difference in radiation characteristic among the feed elements, thereby eliminating the need for a correction operation, such as matrix calculation used in conventional techniques and minimizing the detection errors of the arrival directions.

[1.4. Modifications]

Figure 8:
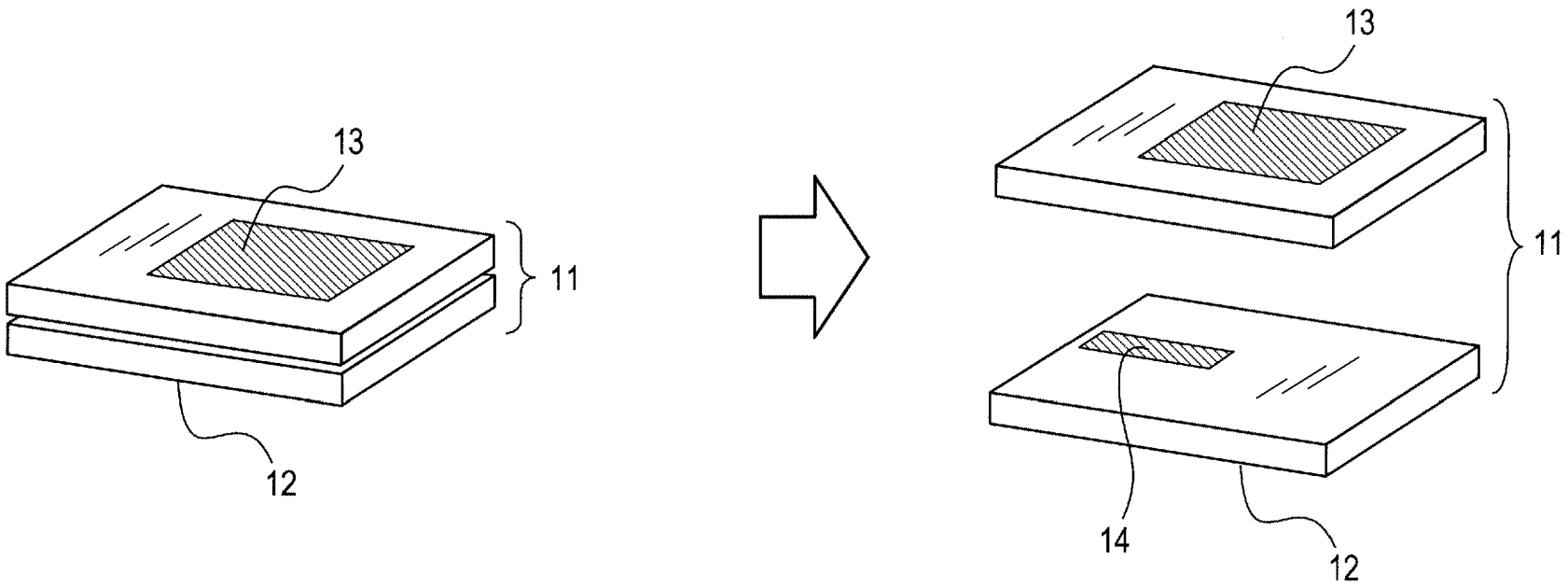
FIG. 8 is an explanatory view which illustrates a modified structure of an antenna apparatus.

The above embodiment uses the feeders extending from the antennas 13*a* and 13*b*, but is not limited to it. For example, a three-layer substrate, as illustrated in FIG. 8, may be used. The three-layer substrate has the ground pattern 12 formed on one of the first layer and the third layer which are externally exposed, the antennas 13*a* and 13*b* formed on the other of the first and third layers, and the feeder 14 formed on the second layer that is an intermediate layer. Electric power is supplied to the antennas 13*b* through a magnetic coupling.

2. Second Embodiment

[2. 1. Structure]

Figure 9:
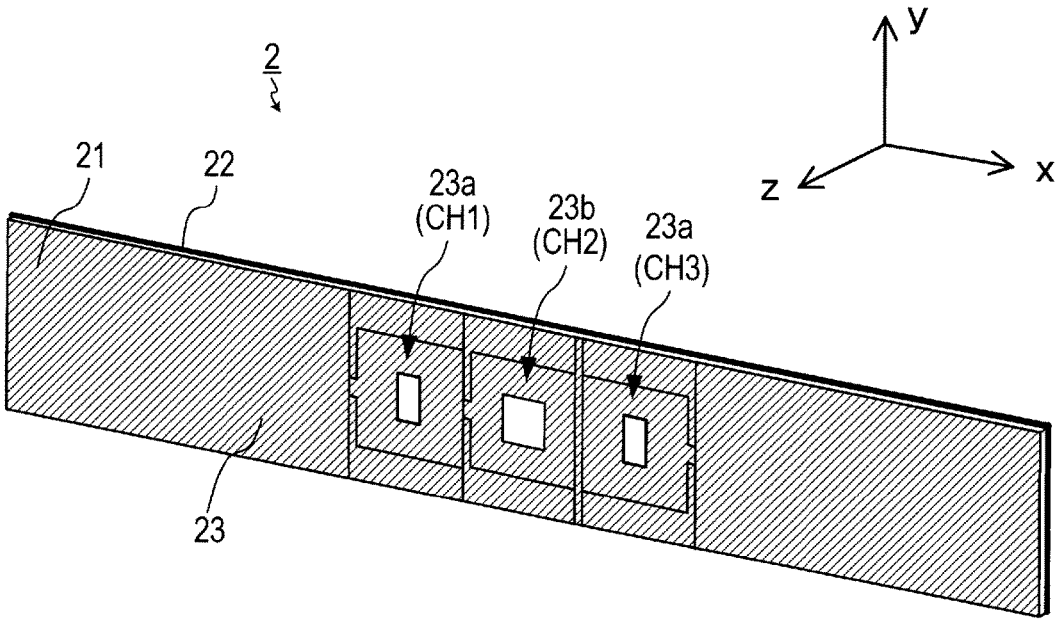
FIG. 9 is a perspective view which illustrates an antenna apparatus in the second embodiment.
Figure 10:
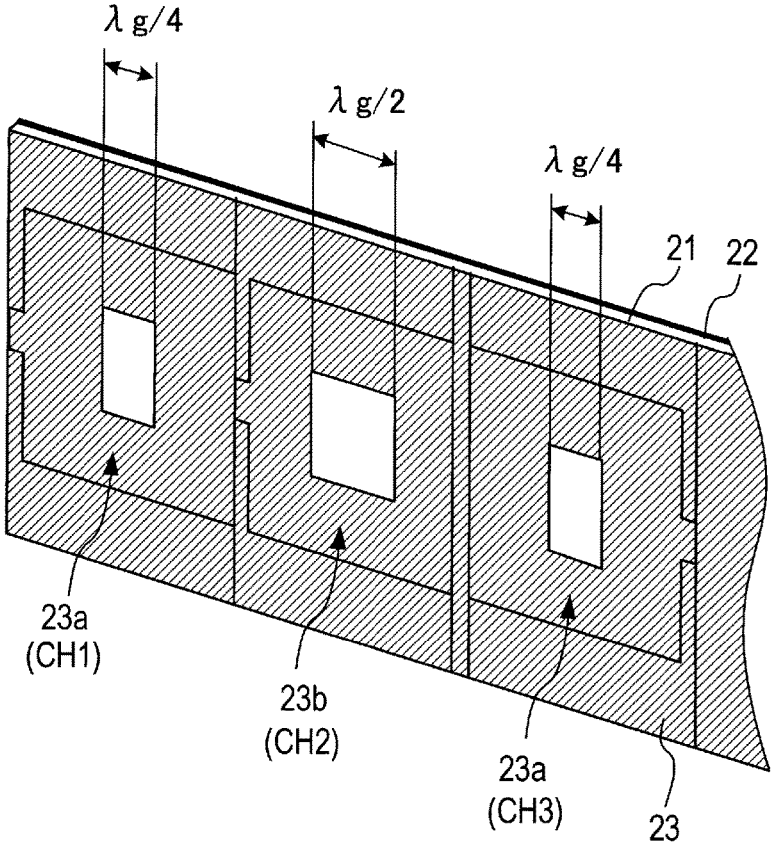
FIG. 10 is an enlarged view of a portion of an antenna apparatus.
Figure 11:
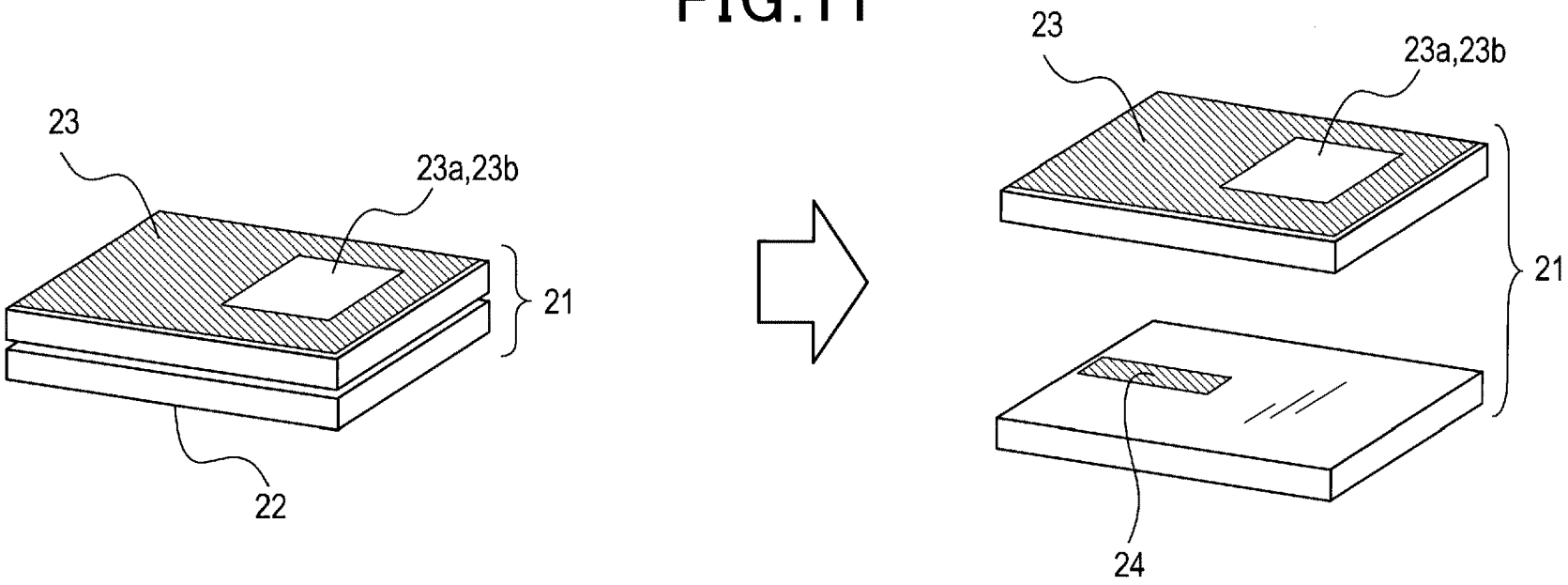
FIG. 11 is an explanatory view which illustrates a structure of a tri-plate antenna.

The antenna apparatus 2 of this embodiment is made of a so-called tri-plate antenna equipped with, as illustrated in FIGS. 9 to 11, the three-layer substrate 21 which is made of dielectric material and includes three pattern-formed layers. The three-layer substrate 21 has the ground pattern 22 which is made of a copper pattern and formed on one (i.e., a first layer) of externally facing two of the pattern-formed layers and the antenna pattern 23 which is made of a copper pattern and formed on the other (i.e., a third layer) of the pattern-formed layers. The antenna pattern 23 covers a front surface of the third layer except N rectangular openings 23*a* and 23*b* where N is an integer of three or more. The three-layer substrate 21 also has the feeders 24 (see FIG. 11) each of which is formed on the intermediate layer (i.e., a second layer) and has an end lying near the center of one of the openings 23*a* and 23*b* and the other end connected to a transmitter-receiver circuit, not shown. The feeders 24 constitute a stripline along with the three-layer substrate 21, the ground pattern 22, and a portion of the antenna pattern 23 except the openings 23*a* and 23*b*.

The openings 23*a* and 23*b* are arrayed in line. Each of the openings 23*a* and 23*b* functions as a discrete antenna. In the following discussion, two of the openings 23*a* and 23*b* which lie at ends of the array of the openings 23*a* and 23*b* will also be each referred to as an end-side antenna (or an outer antenna) 23*a*, while the other opening(s) 23*a* and 23*b* will also be referred to as an inner antenna 23*b*.

The widths or dimensions of the antennas 23*a* and 23*b* in a direction perpendicular to the direction in which the antennas 23*a* and 23*b* are arrayed, that is, the Y-axis direction in the drawing are identical with each other (i.e., λg/2). The dimensions of the end-side antennas 23*a* in the direction in which the antennas 23*a* and 23*b* are arrayed, that is, the X-axis direction in the drawing are λg/4, while the dimension of the inner antenna 23*b* in the X-axis direction is λg/2 (see FIG. 10). The direction in which the antennas 23*a* and 23*b* are arrayed will also be referred to as a polarizing direction along the plane of polarization of radio waves emitted from the antennas 23*a* and 23*b*.

The feeder 24 of each of the antennas 23*a* and 23*b* is placed to extend in a direction in which the antennas 23*a* and 23*b* arrayed. Particularly, the feeders of the two end-side antennas 23*a* are oriented toward the openings from opposite directions.

[2. 2. Measurement]

The tri-plate antenna is, unlike the patch antenna employed in the first embodiment, not designed to use resonance in the openings 23*a* and 23*b*, thereby enabling the configuration of the openings 23*a* and 23*b* to be optionally modified.

Figure 12B:
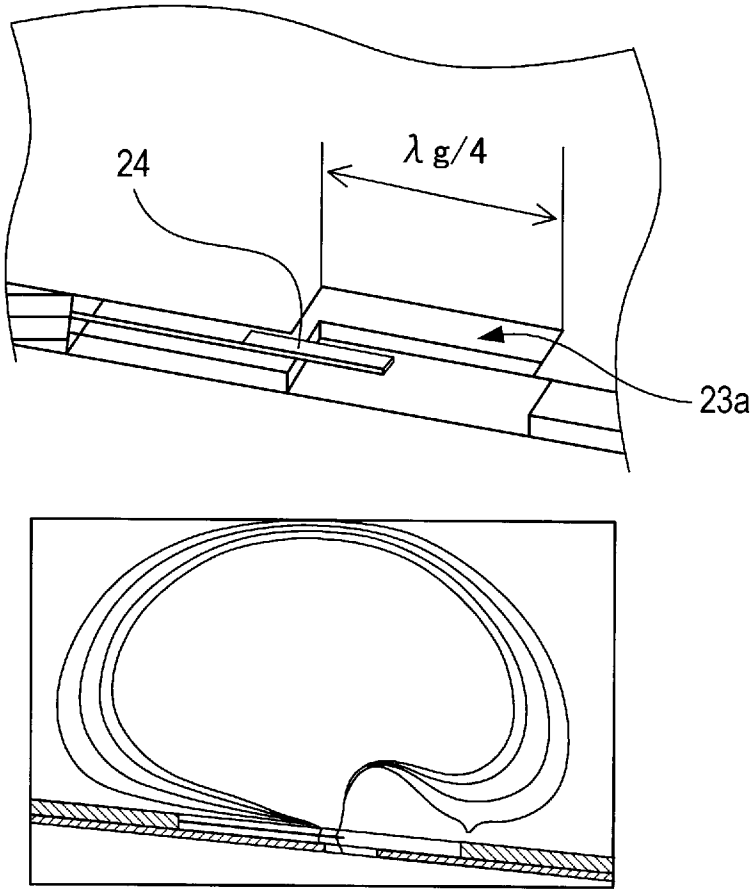
FIG. 12B is an explanatory view which represents a relation between an opening width of an antenna whose opening width is $\lambda g/4$ and a radiation characteristic.
Figure 12A:
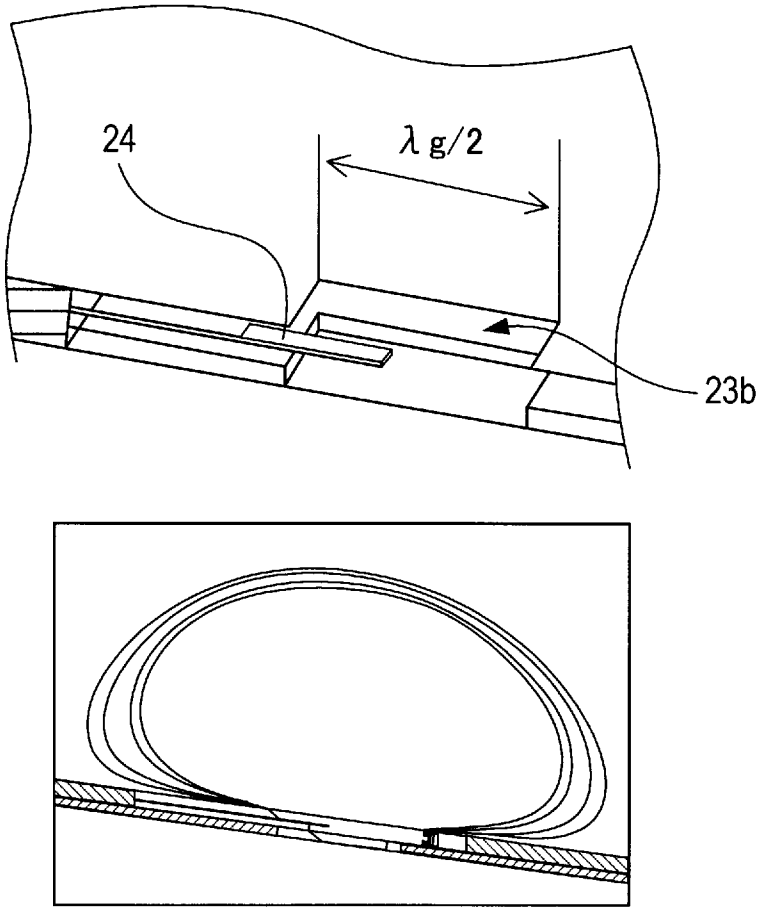
FIG. 12A is an explanatory view which represents a relation between an opening width of an antenna whose opening width is $\lambda g/2$ and a radiation characteristic.
Figure 13:
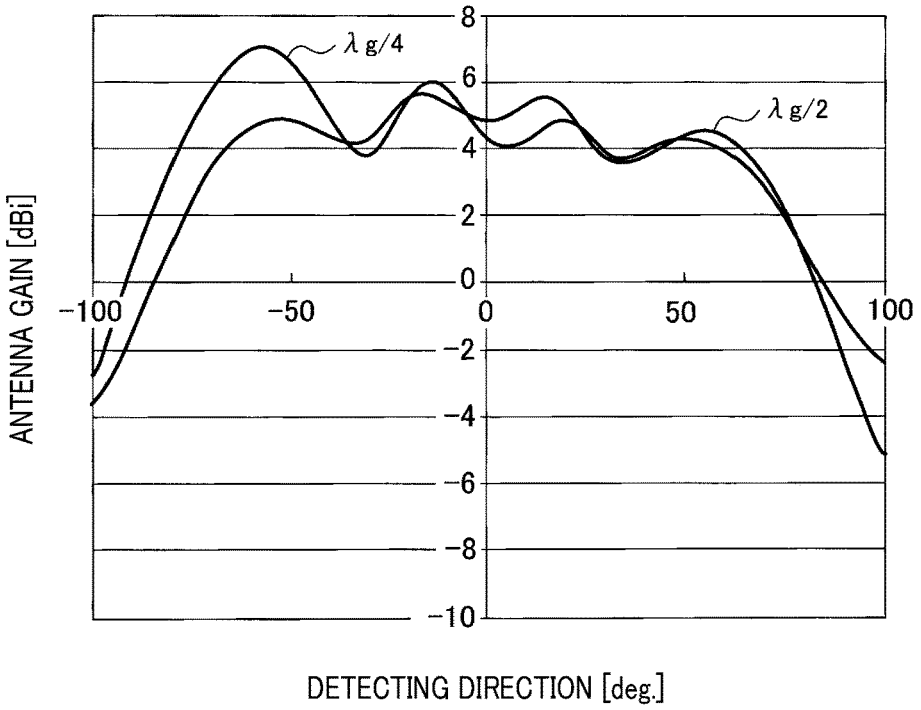
FIG. 13 is a graph which represents radiation characteristics of an antenna in a case where an opening width is $\lambda g/2$ and a case where the opening width is $\lambda g/4$.

When the opening width of the antennas 23*a* and 23*b* in the direction in which the antennas 23*a* and 23*b* are arrayed is selected to be λg/2, it results in, as illustrated in FIG. 12A, uniformity in radiation characteristic regardless of the detecting directions. Changing the opening width from λg/2 will cause the radiation characteristic to be gradually biased. When the opening width reaches λg/4, the radiation characteristic is, as illustrated in FIG. 12B, most biased. Such a change is shown in a graph of FIG. 13. The radiation characteristic has a bias in which the radiant intensity in a region where there is the feeder 24 is greater than that in a region where there is no feeder.

Figure 14:
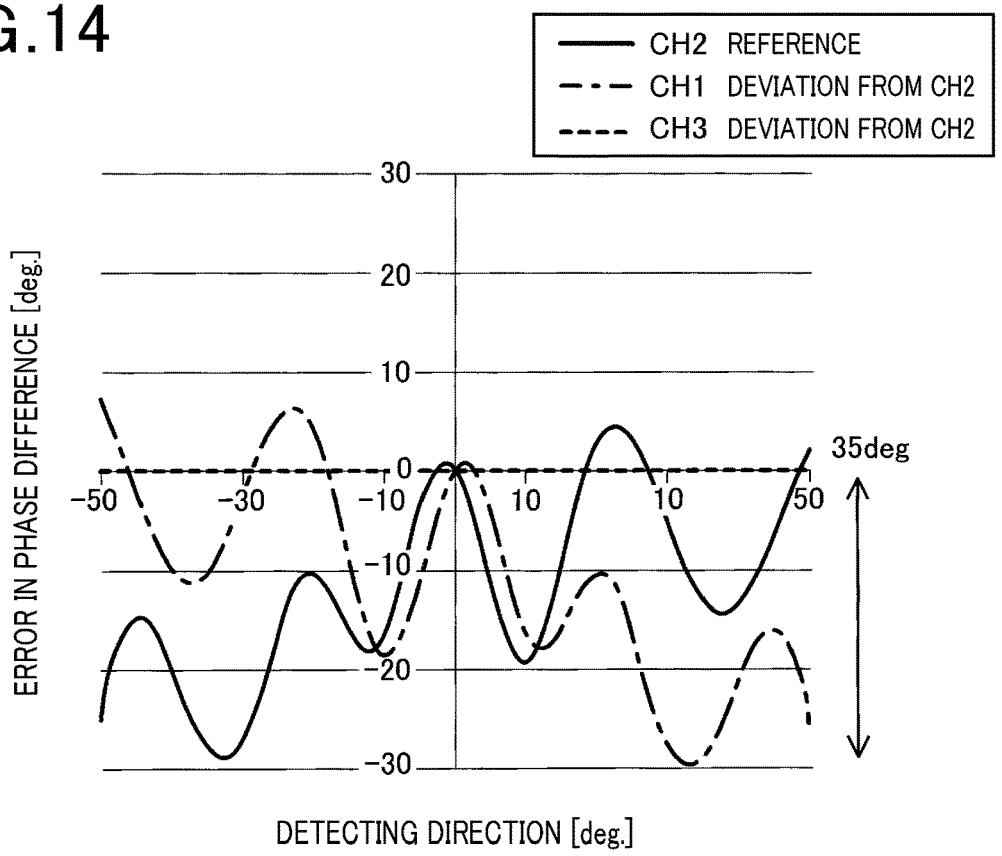
FIG. 14 is a graph which an error in phase difference detected by each antenna in an antenna apparatus of a comparative example made of the antennas whose opening widths are identical with each other.
Figure 15:
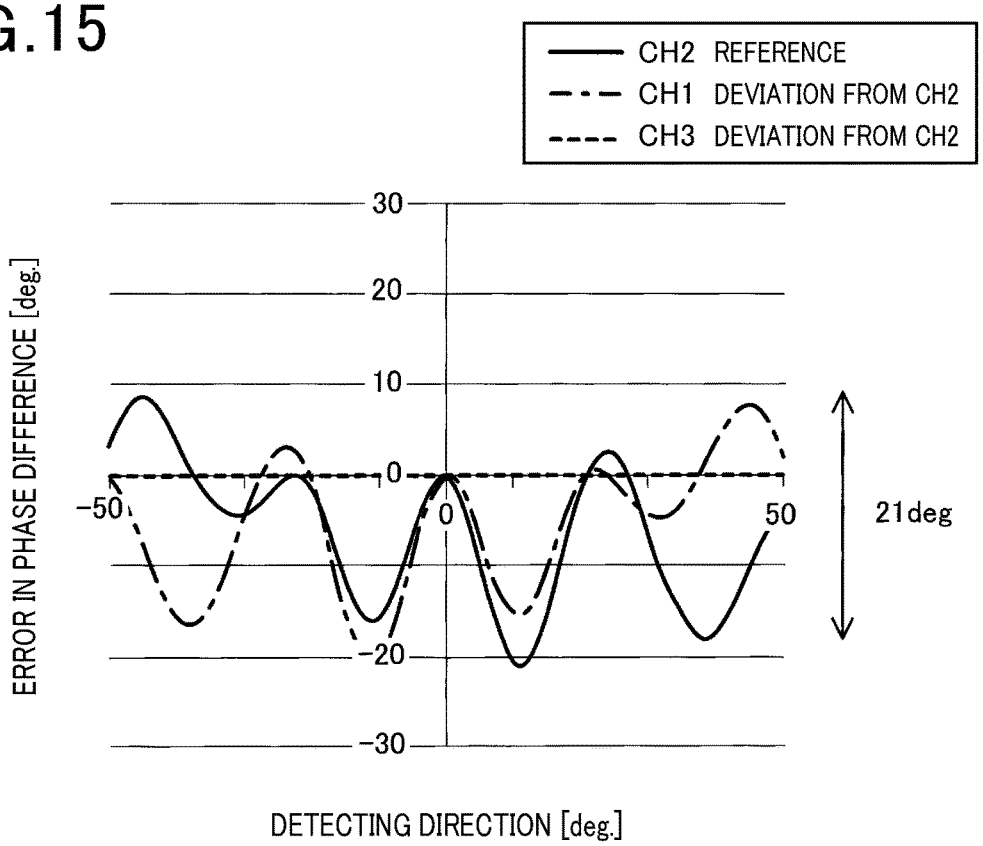
FIG. 15 is a graph which represents an error in phase difference detected by each antenna in an antenna apparatus of the second embodiment.

FIGS. 14 and 15 represent results of simulations in the embodiment (M=3) in which the opening width of the inner antenna 23*b* (CH2) is selected to be λg/2, and the opening width of the end-side antennas 23*a* (CH1 and CH3) is selected to be λg/4 and a comparative example in which the opening widths of all antennas are set identical with each other (λg/2). Specifically, FIGS. 14 and 15 indicate errors or deviations of phase differences, as detected by the respective feed elements, from a theoretical value on the basis of one (i.e., the channel CH2) of the feed elements for each detecting direction (i.e., each arrival direction). Note that a relation between the antenna interval d and the detecting direction θ is shown in FIG. 5. The theoretical value of the phase difference detected by each of the feed elements is represented in FIG. 6. In the simulations, the radio wave frequency is 24.15 GHz. The antenna interval d is 5.2 mm. The detecting direction θ is expressed by an angle where in the X-Z plane in FIG. 9, the Z-axis direction is defined as 0°, a counterclockwise direction from the Z-axis is expressed as plus, and a clockwise direction from the Z-axis is expressed as minus.

It has been found that a maximum error of the phase difference in the comparative example in FIG. 14 is 35 degrees, while it is improved to be 21 degrees in the embodiment of FIG. 15.

Figure 16:
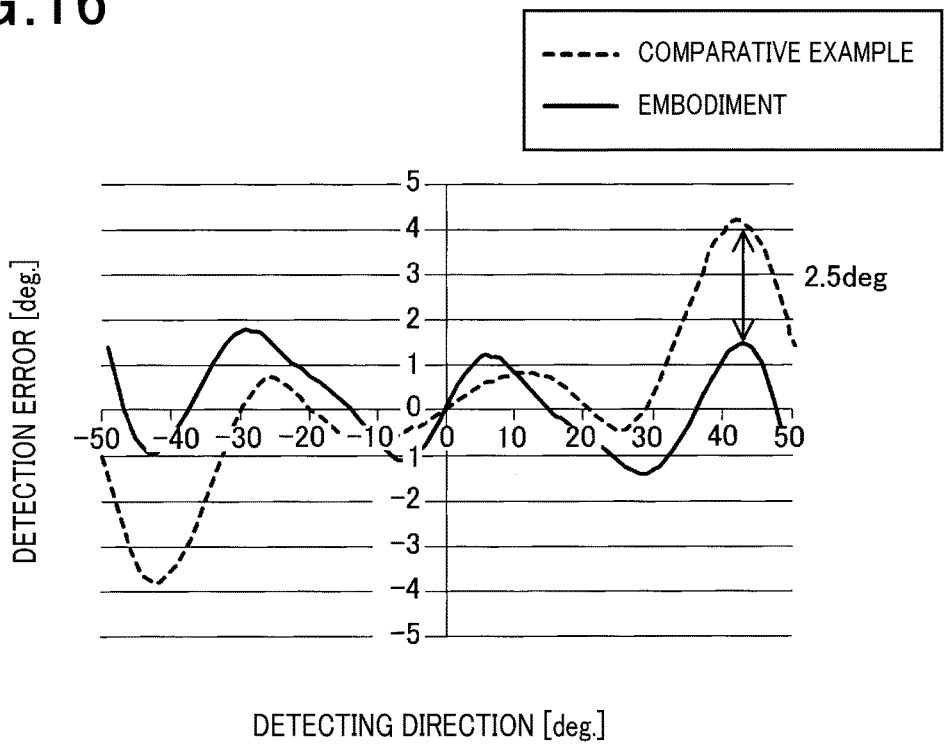
FIG. 16 is a graph which represents detecting errors in arrival direction derived by received signals in an antenna apparatus of the second embodiment and an antenna apparatus of a comparative example.

Detection errors of the arrival directions, as derived through the MUSI algorithm using received signals in the above embodiment and the comparative example are shown in FIG. 16. FIG. 16 shows that the detection error is improved by a maximum of 2.5 degrees (i.e., 4 degrees in the comparative example, while it is 1.5 degrees in the embodiment).

[2. 3. Effects]

The antenna apparatus 2 is designed to use the end-side antennas 23*a* each of which has the opening width adjusted to have the asymmetric radiation characteristic and create an interaction of the end-side antennas 23*a* with the adjacent inner antenna 23*b* to reduce a difference in radiation characteristic between each of the end-side antennas 23*a* and the inner antenna 23*b*, thereby eliminating the need for a correction operation, such as matrix calculation used in conventional techniques and minimizing the detection errors of the arrival directions.

3. Other Embodiments

While the embodiments of the invention have been referred to, the invention are not limited to the above embodiments, but may be modified in various ways.

(1) The function of one of the components in the above embodiments may be shared with some of the components. Alternatively, the functions of some of the components may be combined in one of the components. At least one of the components of the structure of the above embodiments may be replaced with a known structure having a similar function. One or some of the components of the above embodiments may be omitted. At least a portion of the components of one of the above embodiments may be added to or replaced with the component(s) of the other embodiments. The embodiments of the invention may include various modes contained in technical ideas specified by wording of the appended claims.

(2) The invention may alternatively be embodied in various modes, such as systems equipped with the above antenna apparatus.

The invention claimed is:

1. An antenna apparatus comprising:

a plurality of antennas which are arrayed in line;

end-side antennas which are ones of the antennas and lie at ends of an array of the antennas; and inner antennas which are ones of the antennas other than the end-side antennas, wherein the end-side antennas are designed to have a structure different from that of the inner antennas to reduce a difference in directionality between ones of the antennas which are used as feed elements, wherein the end-side antennas are designed as parasitic elements, and the inner antennas are designed as the feed elements, wherein a length of a feeder of each of the antenna elements is set to an integral multiple of half a wavelength of a radio wave transmitted or received, and wherein feeders of the end-side antennas are designed to have ends electrically opened.

2. An antenna apparatus as set forth in claim 1, wherein the feeders of the antennas are implemented by a stripline or a microstripline.

3. An antenna apparatus as set forth in claim 1, wherein the antennas are arranged at equal intervals.

4. An antenna apparatus as set forth in claim 1, wherein the antennas are implemented by patch antennas.

5. An antenna apparatus comprising:

a plurality of antennas which are arrayed in line;

end-side antennas which are ones of the antennas and lie at ends of an array of the antennas; and inner antennas which are ones of the antennas other than the end-side antennas, wherein the end-side antennas are designed to have a structure different from that of the inner antennas to reduce a difference in directionality between ones of the antennas which are used as feed elements, and wherein the end-side antennas and the inner antenna are each designed as a feeder element, and wherein the end-side antennas have an opening width different from that of the inner antenna in a polarizing direction.

6. An antenna apparatus as set forth in claim 5, wherein an opening width of the end-side antennas in a direction in which the antennas are arrayed is selected to be $\lambda g/4$, and the opening width of the inner antennas in the direction in which the antennas are arrayed is selected to be $\lambda g/2$ where $\lambda$ is a transmission line wavelength of a radio wave transmitted or received by the antennas.

7. An antenna apparatus as set forth in claim 5, wherein the antennas are made of a tri-plate antenna formed using a three-layer substrate.

* * * * *